US007956269B1

(12) United States Patent
Chen

(10) Patent No.: US 7,956,269 B1
(45) Date of Patent: Jun. 7, 2011

(54) PEDAL ASSEMBLY FOR PERCUSSION INSTRUMENT

(76) Inventor: Kuo Chang Chen, Taichung (TW)

( * ) Notice: Subject to any disclaimer, the term of this patent is extended or adjusted under 35 U.S.C. 154(b) by 0 days.

(21) Appl. No.: 12/779,899

(22) Filed: May 13, 2010

(51) Int. Cl.
*G10D 13/02* (2006.01)

(52) U.S. Cl. ..... 84/422.1

(58) Field of Classification Search ..... 84/422.1, 84/422.2, 422.3
See application file for complete search history.

(56) References Cited

U.S. PATENT DOCUMENTS 7,525,031 B2 * 4/2009 Fisher, IV ..... 84/411 R
* cited by examiner

*Primary Examiner* — Kimberly R Lockett

(57) ABSTRACT

The pedal assembly of the present invention has a base plate, two rack poles, a pedal, an axle member and a transmission member. The axle member includes a first sleeve, an axial unit and two first bearings. A first axial bore is defined in the first sleeve. The axial unit has a first connecting section and an extending section. The first connecting section is received in the first axial bore. The first bearings are disposed between the first sleeve and the axial unit. The axial unit is rotatable independent from the first sleeve. The first sleeve is rotatably supported by one of the rack poles, and the axial unit is rotatably supported by the other one of the rack poles.

7 Claims, 5 Drawing Sheets

PEDAL ASSEMBLY FOR PERCUSSION INSTRUMENT

BACKGROUND OF THE INVENTION

1. Field of the Invention

The present invention relates to a pedal assembly for a percussion instrument.

2. Description of the Prior Art

Some of the conventional pedal assemblies are adapted for two hammers to install thereon. The two hammers are independently rotatable about two axles. Such pedal assembly needs a special rack to support the axles. The rack thereof has two rack poles, one of which is fork-shaped. That is, the two rack poles provide at least three points to support the axles. Due to the customized standard of the rack, the cost thereof is inevitably raised.

The present invention is, therefore, arisen to obviate or at least mitigate the above mentioned disadvantages.

SUMMARY OF THE INVENTION

The main object of the present invention is to provide a pedal assembly which can support two independently rotatable hammers without special-standard rack poles.

To achieve the above and other objects, the pedal assemble of the present invention includes a base plate, two rack poles, a pedal, an axle member and a transmission member. The rack poles extend upward from the base plate. The pedal has a pivoting end and a connecting end. The pivoting end is pivoted to the base plate. The axle member includes a first sleeve, an axial unit and two first bearings. The first sleeve and the axial unit are coaxial. A first axial bore is defined in the first sleeve. The axial unit has a first connecting section and an extending section. The first connecting section is received in the first axial bore. The first bearings are disposed between the first sleeve and the axial unit. The axial unit is rotatable independent from the first sleeve. The first sleeve is rotatably supported by one of the rack poles, and the axial unit is rotatably supported by the other one of the rack poles. The transmission member connects the pivoting end to the first sleeve or the axial unit. Thereby, the first sleeve or the axial unit which is connected by the transmission member rotates when the pedal pivots.

As such, there is no need for any of the rack poles to be fork-shaped in order to support two hammers.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
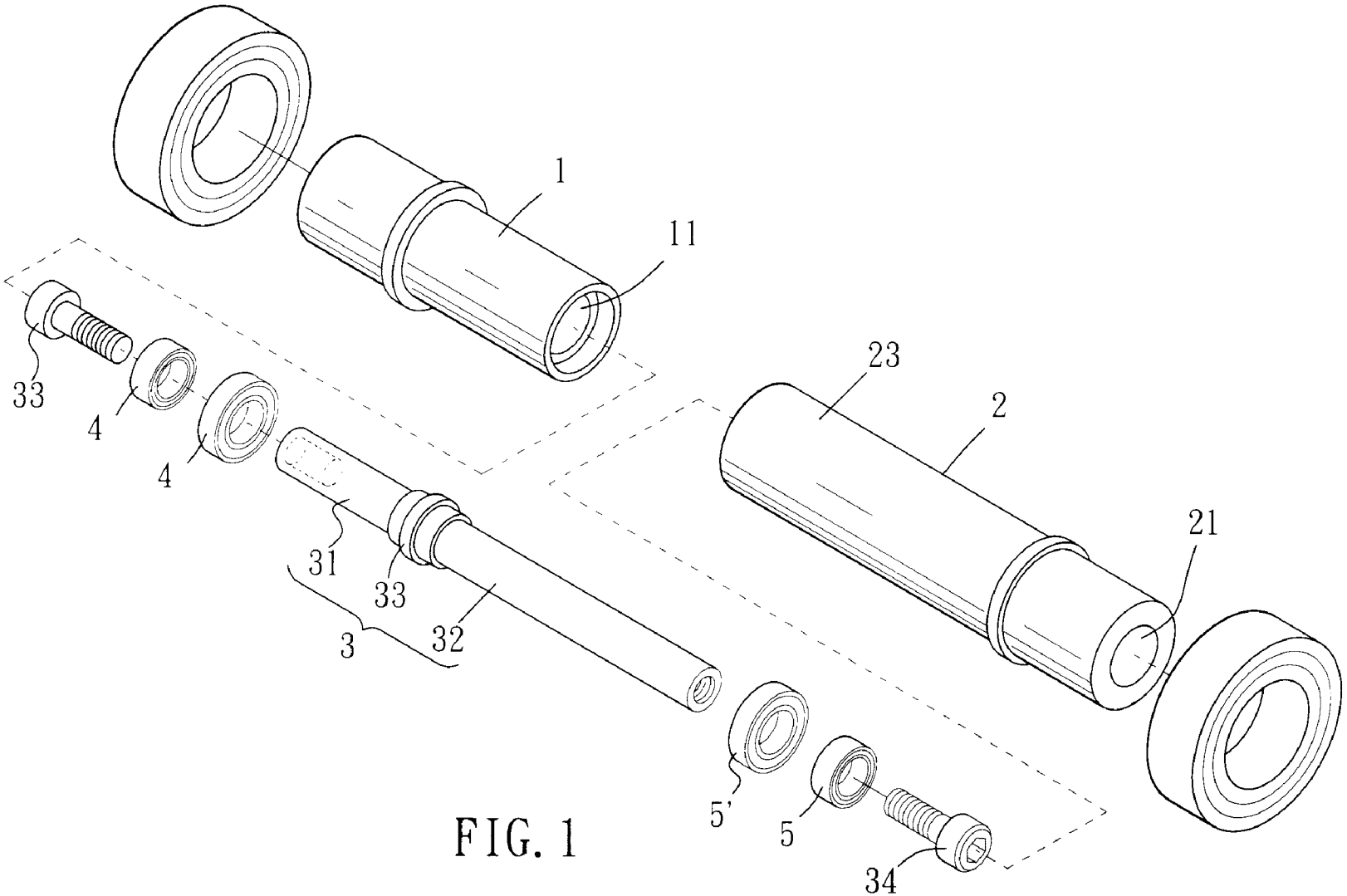
FIG. 1 is a breakdown drawing showing a pedal assembly of the present invention.
Figure 2A:
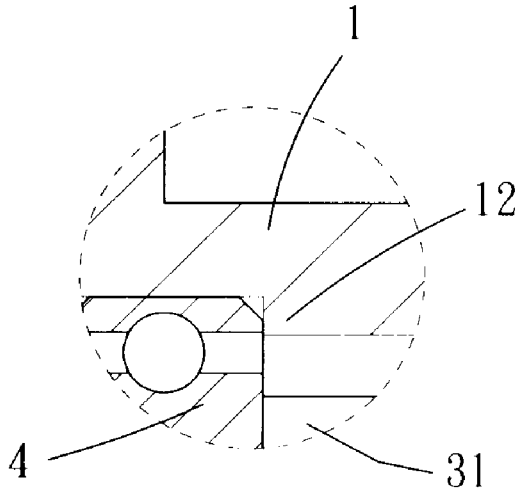
FIG. 2A is a partial enlargement of FIG. 2.
Figure 2B:
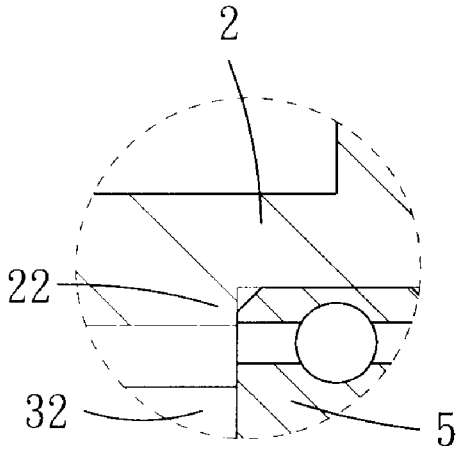
FIG. 2B is another partial enlargement of FIG. 2.
Figure 2:
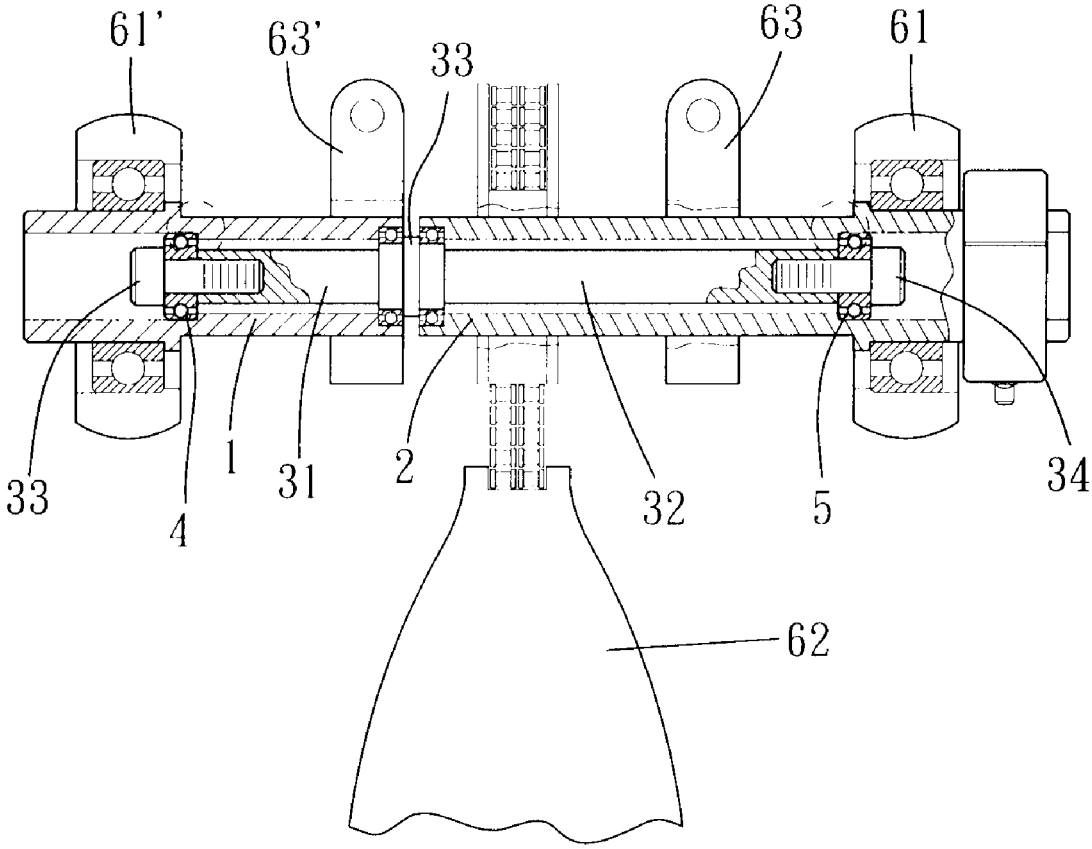
FIG. 2 is a profile showing a pedal assembly of the present invention.

Please refer to FIG. 1 and FIG. 2. The present invention provides a pedal assembly for a percussion instrument. The pedal assembly includes an axle member having a first sleeve 1, a second sleeve 2, a rod element 3 and two first bearings 4, 4', and two second bearings 5, 5'.

A first axial bore 11 is defined in the first sleeve 1, and a second axial bore 21 is defined in the second sleeve 2. The axial bores 11 and 21 have at least one open end respectively. Please refer to FIG. 2A and FIG. 2B. The first axial bore 11 has two open ends, which means the first sleeve 1 has a penetrating first axial bore 11. The first sleeve 1 has a first inner surface, on which a first abutting portion 12 is formed and is radially protrusive therefrom. The second axial bore 21 also has two open ends. The second sleeve 2 has a second surface, on which a second abutting portion 22 is formed and is radially protrusive therefrom. The second sleeve is an extension section. The rod element 3 includes a first connecting section 31 and a second connecting section 32. The first connecting section 31 is received in the first axial bore 11, and the second connecting section 32 is received in the second axial bore 21. Therefore, the first sleeve 1, the second sleeve 2 and the rod element 3 are coaxial. The rod element 3 may be further formed with an annular rib 33 locating between the first connecting section 31 and the second connecting section 32. Thus the rotation of the first sleeve will not interfere in that of the second sleeve. A first screw 34 and a second screw 35 can be threaded to both ends of the rod element 3.

The first bearings 4 and 4' are received in the first axial bore 11 and are disposed between the first sleeve 1 and the first connecting section 31. Preferably, the first bearings 4 and 4' locate at both ends of the first connecting section 31. The first screw 34 is threaded to a distal end of the first connecting section 31. More specifically, the first bearing 4 is clamped and positioned between the first screw 34 and the first abutting portion 12.

The second bearings 5 and 5' are received in the second axial bore 21 and are disposed between the second sleeve 2 and the second connecting section 32. Preferably, the second bearings 5 and 5' locate at both ends of the second connecting section 32. The second screw 35 is threaded to a distal end of the second connecting section 32. More specifically, the second bearing 5 is clamped and positioned between the second screw 35 and the second abutting portion 22.

Figure 3:
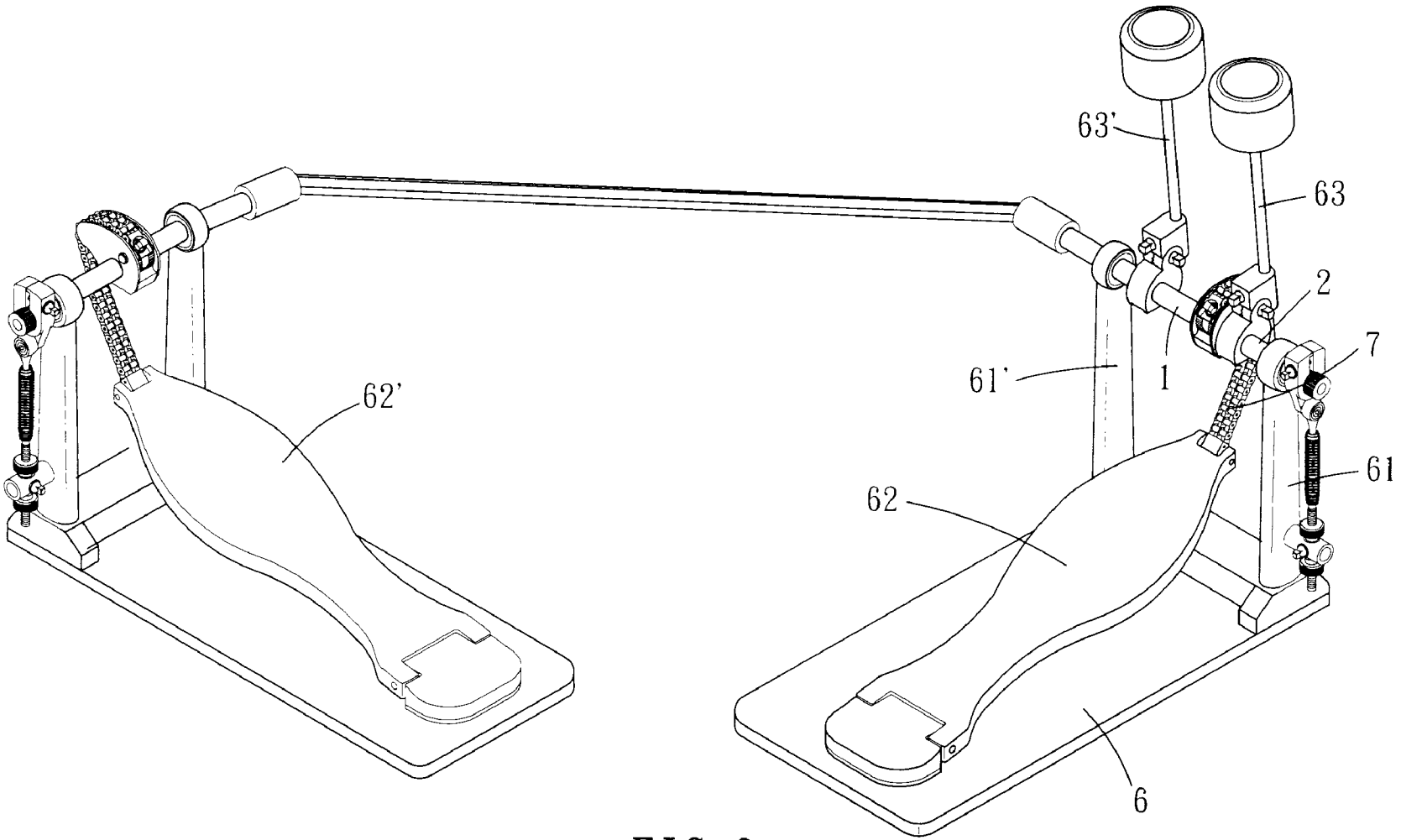
FIG. 3 is a perspective drawing showing a usage state of a pedal assembly of the present invention.

Please refer to FIG. 2 and FIG. 3. The pedal assembly further includes base plate 6, two rack poles 61, 61', a pedal 62 and a transmission member 7. The rack poles 61 and 61' extend upward from the base plate 6, and the pedal 62 has a connecting end and a pivoting end pivoted to the base plate 6. The first sleeve 1 is rotatably supported by one of the pole 61, and the second sleeve 2 is, on the other hand, supported by the other one of the pole 61'. The transmission member 7 may be a chain, a belt or a linkage rod(s), and the transmission member 7 connects the pivoting end of the pedal 62 to the second sleeve 2. Thereby, the second sleeve 2 correspondingly rotates as the pedal pivots. The second sleeve 2 is adapted for a hammer 63 to install thereon. As such, the hammer 63 sways as the user steps on the pedal 62. The first sleeve can be, on the other hand, driven by another pedal assembly 62', and the first sleeve is adapted for a hammer 63' to install thereon.

Figure 4:
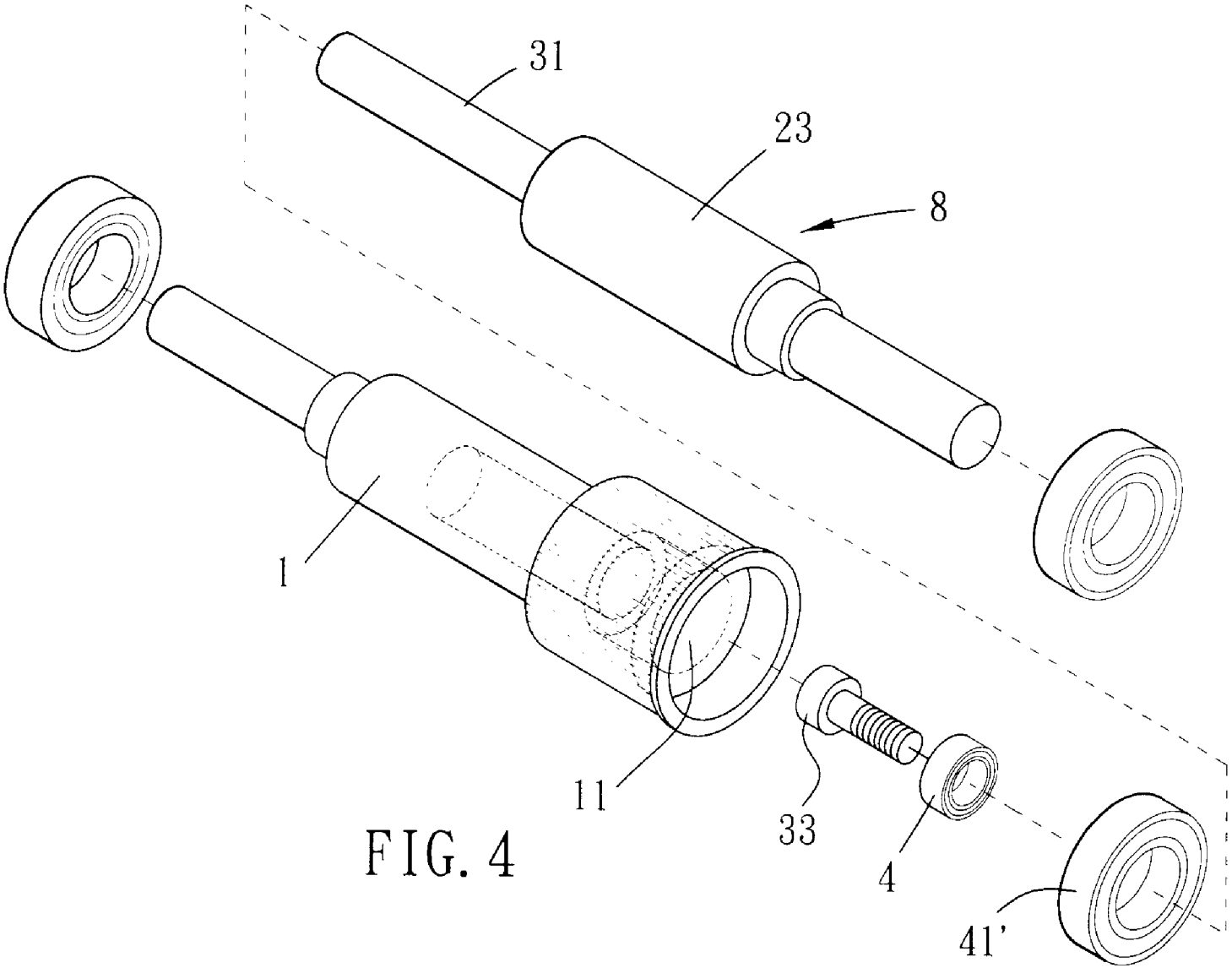
FIG. 4 is a breakdown drawing showing another pedal assembly of the present invention.
Figure 5:
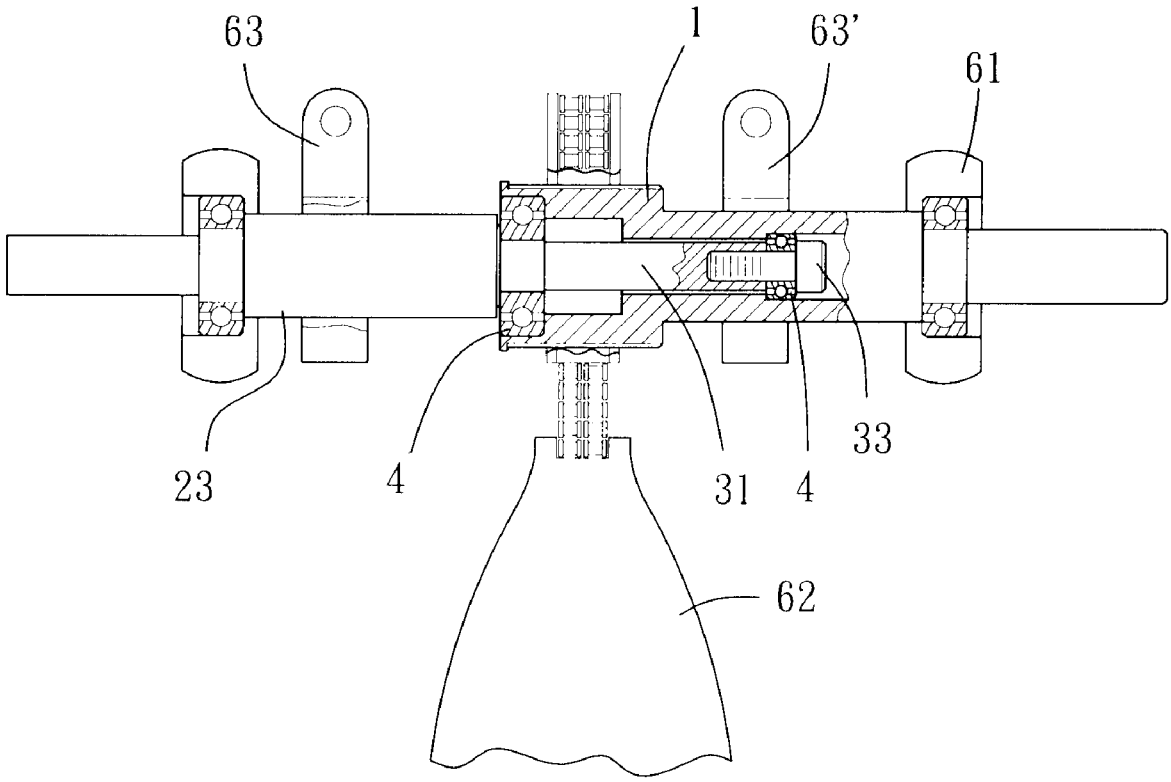
FIG. 5 is profile showing another pedal assembly of the present invention.

Please refer to FIG. 4 and FIG. 5 for another embodiment of the present invention. In the present embodiment, the second sleeve is integrally formed on the rod element to form an axle member 8. Thus the second bearings are no more needed in the present embodiment. The first sleeve 1 and the axle member 8 are also supported by the rack poles as shown in FIG. 3.

What is claimed is:

1. A pedal assembly for a percussion instrument, comprising:

a base plate;

two rack poles, extending upward from the base plate;

a pedal, having a pivoting end and a connecting end, the pivoting end being pivoted to the base plate;

an axle member, comprising a first sleeve, an axial unit and two first bearings, the first sleeve and the axial unit being coaxial, a first axial bore being defined in the first sleeve, the axial unit having a first connecting section and an extending section, the first connecting section being received in the first axial bore, the first bearings being disposed between the first sleeve and the axial unit, the axial unit being rotatable independent from the first sleeve, the first sleeve being rotatably supported by one of the rack poles, the axial unit being rotatably supported by the other one of the rack poles;

a transmission member, connecting the pivoting end to the first sleeve or the axial unit, whereby the first sleeve or the axial unit which is connected by the transmission member rotates when the pedal pivots.

2. The pedal assembly of claim 1, wherein the first hearings locate at both ends of the first connecting section respectively.

3. The pedal assembly of claim 1, wherein the first axial bore has two open ends, the first sleeve has a first inner surface, a first abutting portion is formed on the first inner surface, the first abutting portion is radially protrusive from the first inner surface, a first screw is threaded on a distal end of the axial unit, one of the first bearings is clamped between the first screw and the first abutting portion.

4. The pedal assembly of claim 1, wherein the axial unit comprises a second sleeve, a rod element and two second bearings, a second axial bore is defined in the second sleeve, the second sleeve is the extending section, the rod element includes the first connecting section and a second connecting section, the second connecting section is received in the second axial bore, the second sleeve and the rod element are coaxial, the second bearings are disposed between the second sleeve and the rod element, the second sleeve is rotatable independent from the rod element, the second sleeve is rotatably supported by one of the rack poles.

5. The pedal assembly of claim 4, wherein the second bearings locate at both ends of the second connecting section respectively.

6. The pedal assembly of claim 4, wherein the second axial bore has two open ends, the second sleeve has a second inner surface, a second abutting portion is formed on the second inner surface, the second abutting portion is radially protrusive from the first inner surface, a second screw is threaded on a distal end of the rod element, one of the second bearings is clamped between the second screw and the second abutting portion.

7. The pedal assembly of claim 4, wherein the rod element is formed with an annular rib locating between the first connecting section and the second connecting section.

* * * * *